US008581829B2

(12) United States Patent
Cheng et al.

(10) Patent No.: US 8,581,829 B2
(45) Date of Patent: Nov. 12, 2013

(54) BACKLIGHT DRIVING METHOD AND DISPLAY DEVICE

(75) Inventors: Hsiang-Yuan Cheng, Hsin-Chu (TW); Shih-Hsun Lo, Hsin-Chu (TW); Chen-Lun Chiu, Hsin-Chu (TW); Shan-Fu Yuan, Hsin-Chu (TW); Yu-Wei Liao, Hsin-Chu (TW)

(73) Assignee: AU Optronics Corp., Hsinchu (TW)

( * ) Notice: Subject to any disclaimer, the term of this patent is extended or adjusted under 35 U.S.C. 154(b) by 406 days.

(21) Appl. No.: 12/905,791

(22) Filed: Oct. 15, 2010

(65) Prior Publication Data

US 2011/0273367 A1 Nov. 10, 2011

(30) Foreign Application Priority Data

May 5, 2010 (TW) ..... 99114419 A

(51) Int. Cl.
*G09G 3/36* (2006.01)

(52) U.S. Cl.
USPC ..... 345/102; 349/59; 349/70

(58) Field of Classification Search
USPC ..... 345/100–102
See application file for complete search history.

(56) References Cited

U.S. PATENT DOCUMENTS

| | | | | |
|---|---|---|---|---|
| 6,903,716 | B2 * | 6/2005 | Kawabe et al. | 345/99 |
| 2003/0169247 | A1 | 9/2003 | Kawabe et al. | |
| 2005/0219188 | A1 | 10/2005 | Kawabe et al. | |
| 2007/0103425 | A1 * | 5/2007 | Tanaka et al. | 345/102 |
| 2007/0146300 | A1 * | 6/2007 | Wu et al. | 345/102 |
| 2007/0171175 | A1 | 7/2007 | Chiang et al. | |

FOREIGN PATENT DOCUMENTS

| | | |
|---|---|---|
| CN | 1811892 | 8/2006 |
| CN | 1941060 A | 4/2007 |
| CN | 101025498 | 8/2007 |
| TW | I223228 | 11/2004 |
| TW | I273546 | 2/2007 |
| TW | 200837688 | 9/2008 |

OTHER PUBLICATIONS

Taiwan Intellectual Property Office, Search Report issued on Jun. 5, 2013.
Taiwan Intellectual Property Office, Office Action issued on Jun. 10, 2013.

* cited by examiner

*Primary Examiner* — Kevin M Nguyen
*Assistant Examiner* — Kenneth B Lee, Jr.
(74) *Attorney, Agent, or Firm* — WPAT, PC; Justin King

(57) ABSTRACT

Exemplary backlight driving method and display device are provided. The display device includes a light source array. The light source array includes a first group of light-emitting rows and a second group of light-emitting rows. The backlight driving method includes the steps of: firstly, receiving a gate driving frequency of the display device; subsequently, generating a backlight driving frequency according to the gate driving frequency; and afterwards, sequentially providing a first row driving voltage to the first group of light-emitting rows in a first time period and sequentially providing a second row driving voltage to the second group of light-emitting rows in a second time period, according to the backlight driving frequency. The first time period and the second time period have different phases from each other, and the gate driving frequency is different from the backlight driving frequency.

24 Claims, 6 Drawing Sheets

BACKLIGHT DRIVING METHOD AND DISPLAY DEVICE

BACKGROUND

1. Technical Field

The present invention generally relates to display technology fields and, particularly to a backlight driving method and a display device.

2. Description of the Related Art

Nowadays, display panels of non-emissive display devices such as liquid crystal display devices are non-emissive and thus backlight modules are necessarily required for providing backlight illumination for such display panels. Light sources suitable for the backlight modules can be primarily classified into cold cathode fluorescent lamps (CCFLs), light-emitting diodes (LEDs) and other electroluminescence devices.

However, in the prior art, a driving frequency for backlight would interfere with images displayed on a relevant liquid crystal display screen. For example, when the backlight driving frequency (i.e., generally lamp frequency) approximately is close to a multiple of a video refreshing frequency, the display screen would appear black lines or black bands moving along a difference between the frequencies, causing a waving noise or visual noise.

BRIEF SUMMARY

Accordingly, the present invention is directed to a backlight driving method, can effectively relieve the waving noise or visual noise and improve the image quality.

More specifically, a backlight driving method in accordance with an embodiment of the present invention is adapted to a display device. Herein, the display device includes a light source array. The light source array includes a first group of light-emitting rows and a second group of light-emitting rows. In the embodiment, the backlight driving method includes following steps of: firstly, receiving a gate driving frequency of the display device; subsequently, generating a backlight driving frequency according to the gate driving frequency; and afterwards, sequentially providing a first row driving voltage to the first group of light-emitting rows in a first time period and sequentially providing a second row driving voltage to the second group of light-emitting rows in a second time period both according to the backlight driving frequency. The first time period and the second time period have different phases from each other, and the gate driving frequency is different from the backlight driving frequency.

In one embodiment, the first time period and the second time period are in a same frame period. Moreover, the step of sequentially providing a first row driving voltage to the first group of light-emitting rows in a first time period and sequentially providing a second row driving voltage to the second group of light-emitting rows in a second time period includes sequentially providing the first row driving voltage and the second row driving voltage to the respective first group of light-emitting rows and second group of light-emitting rows in an alternate manner. Even more, a scanning direction of sequentially providing the first row driving voltage to the first group of light-emitting rows is same as or different from a scanning direction of sequentially providing the second row driving voltage to the second group of light-emitting rows.

In an alternative embodiment, the first time period and the second time period respectively are in different frame periods. Moreover, the step of sequentially providing a first row driving voltage to the first group of light-emitting rows in a first time period and sequentially providing a second row driving voltage to the second group of light-emitting rows in a second time period includes sequentially providing the first row driving voltage and the second row driving voltage to the respective first group of light-emitting rows and second group of light-emitting rows in an alternate manner. Even more, a scanning direction of sequentially providing the first row driving voltage to the first group of light-emitting rows is same as or different from a scanning direction of sequentially providing the second row driving voltage to the second group of light-emitting rows.

A display device in accordance with an embodiment of the present invention includes a light source array, a column driver circuit and a row driver circuit. The light source array includes a first group of light-emitting rows and a second group of light-emitting rows. The column driver circuit is electrically coupled to the light source array and for providing a column driving voltage to the light source array. The row driver circuit is electrically coupled to the light source array. The row driver circuit further is for receiving a gate driving frequency of the display device, generating a backlight driving frequency according to the gate driving frequency, and sequentially providing a first row driving voltage to the first group of light-emitting rows in a first time period and sequentially providing a second row driving voltage to the second group of light-emitting rows in a second time period both according to the backlight driving frequency. The first time period and the second time period have different phases from each other, and the gate driving frequency is different from the backlight driving frequency.

In one embodiment, the light source array is an organic light source array or a field emission backlight source array.

In summary, the above-mentioned embodiments of the present invention employ a multi-phase (e.g., 2-phase) scanning scheme to drive the light source array of a backlight module and make the backlight driving frequency be different from the gate driving frequency, so that breaking down a constant frequency difference between the gate driving frequency and the backlight driving frequency associated with the prior art which would cause the fan effect (i.e., generally waving noise or visual noise). Accordingly, the image quality of display device is improved.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 4(*b*) shows still another schematic scanning order used by the backlight driving method of FIG. 2 in a same frame period.

FIG. 4(*c*) shows even still another schematic scanning order used by the backlight driving method of FIG. 2 in a same frame period.

FIG. 5(*b*) shows another schematic scanning order used by the backlight driving method of FIG. 2 in different frame periods.

DETAILED DESCRIPTION

In the following detailed description of the preferred embodiments, reference is made to the accompanying drawings which form a part hereof, and in which are shown by way of illustration specific embodiments in which the invention may be practiced. In this regard, directional terminology, such as "up," "bottom," "row," "column," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "coupled" and variations thereof herein are used broadly and encompass direct and indirect connections, and couplings. Accordingly, the drawings and descriptions will be regarded as illustrative in nature and not as restrictive.

Figure 1:
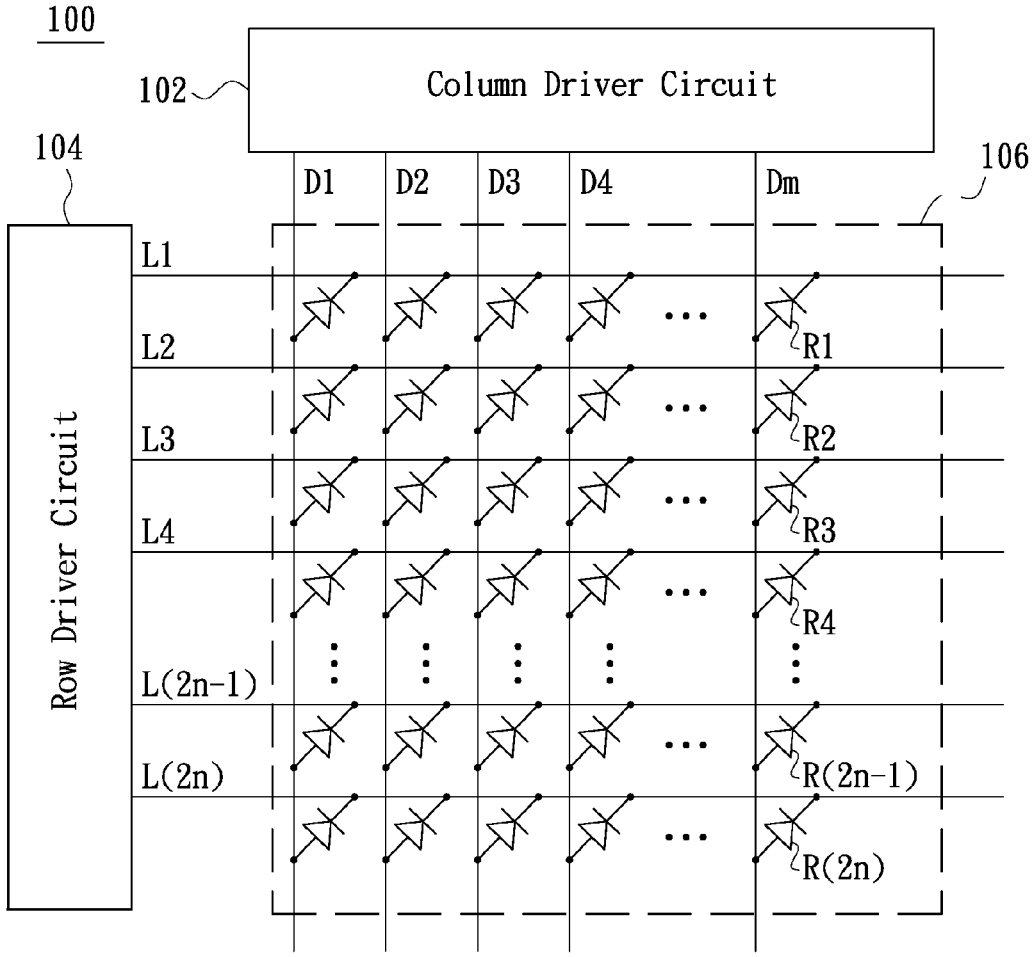
FIG. 1 shows a schematic circuit block diagram of a backlight part of a display device in accordance with an embodiment of the present invention.

Referring to FIG. 1, showing a schematic circuit block diagram of a backlight part of a display device in accordance with an embodiment of the present invention. As illustrated in FIG. 1, the display device 10 includes a column driver circuit 102, a row driver circuit 104 and a light source array 106. The column driver circuit 102 is electrically coupled to the light source array 106 through column driving lines D1~Dm, and the row driver circuit 104 is electrically coupled to the light source array 106 through row driving lines L1~L(2n); where m, n are positive integers. The light source array 106 is constituted by multiple light-emitting diodes and can be grouped into a first group of light-emitting rows L1, L3, . . . , L(2n−1) and a second group of light-emitting rows L2, L4, . . . , L(2n) cooperatively with the row driving lines L1~L(2n).

In a preferred embodiment of the present invention, the light-emitting diodes can be, for example small molecules organic light-emitting diodes (OLEDs) or polymer organic light-emitting diodes (PLEDs), but not to limit the present invention. Moreover, the light-emitting diodes can be, for example disposed in a backlight module (not shown), or directly formed on a pixel circuit substrate of the display device 100 by a particular process and whereby forming an in-cell light source array.

In a preferred embodiment of the present invention, the organic light source array 106 can be replaced by a field emission backlight source array.

In a preferred embodiment of the preset invention, as to the row driving lines L1~L(2n), each of the row driving lines L1~L(2n) has m number of light emitting diodes coupled therewith. As to the column driving lines D1~Dm, each of the column driving lines D1~Dm has 2n number of light emitting diodes coupled therewith. As far as a single light-emitting diode is concerned, when a voltage difference between a row driving voltage and a column driving voltage both applied to the light-emitting diode is enough to turn on the light-emitting diode, the light-emitting diode is lighted on.

Figure 2:
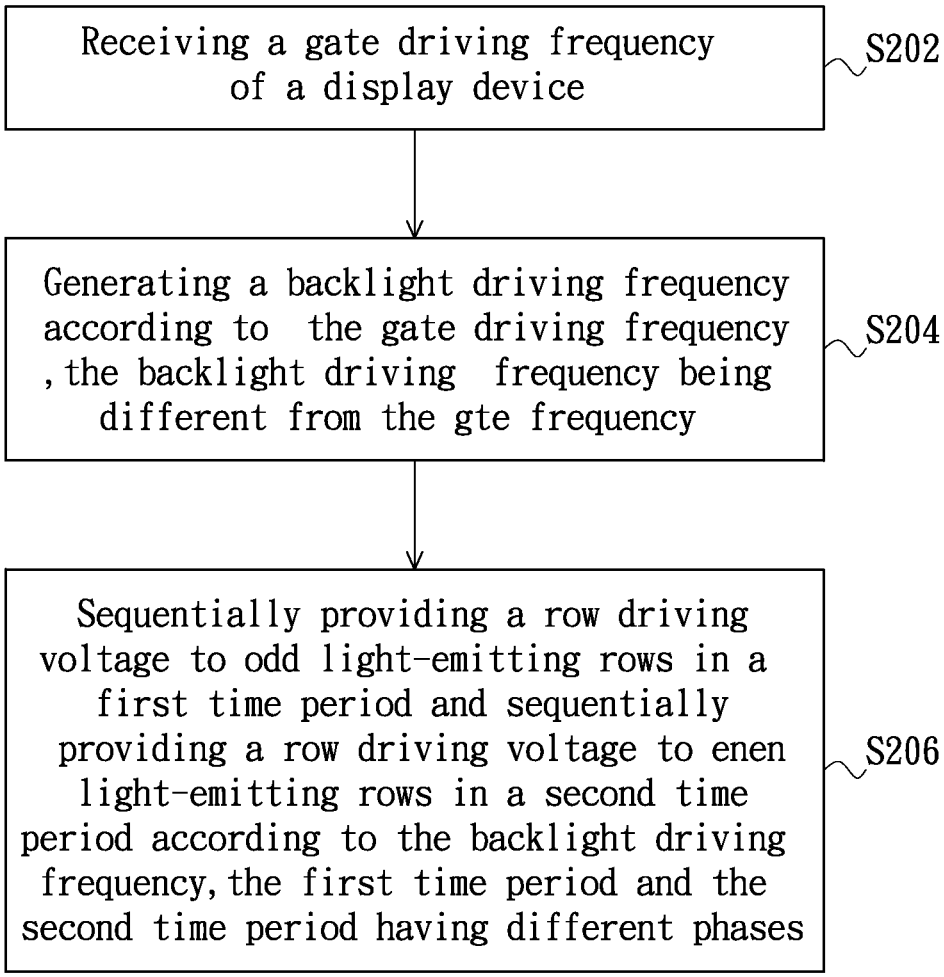
FIG. 2 shows a flowchart of a backlight driving method in accordance with an embodiment of the present invention.

Referring to FIG. 1 and FIG. 2 together, FIG. 2 showing a flowchart of a backlight driving method in accordance with an embodiment of the present invention. The display device 100 (e.g., a microprocessor of the display device 100) would generate a gate driving frequency after the display device 100 is started. The gate driving frequency then is transmitted to the column driver circuit 102 and the row driver circuit 104 (Step S202). It is understood to the skilled person in the art, the gate driving frequency generally is a scanning frequency of a display frame of the display device 100.

In the illustrated embodiment, the column driver circuit 102 and the row driving circuit 104 would generate a backlight driving frequency (Step S204) after they receive the gate driving frequency. It is understood to the skilled person in the art, the backlight driving frequency can be generated by the microprocessor of the display device 100 instead and then transmitted to both the column driver circuit 102 and the row driver circuit 104.

In a preferred embodiment of the present invention, a rising edge and a falling edge of a period of the gate driving frequency respectively occur at same time points as a rising edge and a falling edge of corresponding periods of the backlight driving frequency. Moreover, the gate driving frequency is different from the backlight driving frequency.

Subsequently, the row driver circuit 104 sequentially provides a row driving voltage to the first group of light-emitting rows L1, L3, . . . , L(2n−1) in a first time period and sequentially provides a row driving voltage to the second group of light-emitting rows L2, L4, . . . , L(2n) in a second time period according to the backlight driving frequency, the first time period has a phase different from that of the second time period, while a frequency of the first time period is the same as that of the second time period (Step S206).

Figure 3:
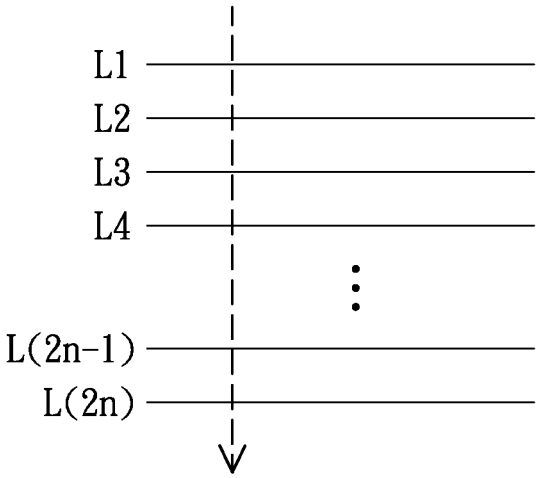
FIG. 3 shows a schematic scanning order used by the backlight driving method of FIG. 2 in a same frame period.

Referring to FIG. 3, showing a scanning order used by the backlight driving method of FIG. 2 in a same frame period. The row driver circuit 104 sequentially scans the light-emitting rows L1~L(2n) from up to bottom. Moreover, after the display device 100 of FIG. 1 is started, the column driver circuit 102 continuously provides a column driving voltage to the light source array 106. A scanning time interval for row by row is assumed to be 1 microsecond and an exemplary embodiment will be described below in detail. In particular, at the moment of $1^{st}$ microsecond (belonging to the first time period), a row driving voltage provided from the row driver circuit 104 through the row driving line L1 and the column driving voltage have an enough voltage difference for lighting on the light-emitting diodes R1 coupled to the row driving line L1. At the moment of $2^{nd}$ microsecond (belonging to the second time period), a row driving voltage provided from the row driver circuit 104 through the row driving line L2 and the column driving voltage have an enough voltage difference for lighting on the light-emitting diodes R2 coupled to the row driving line L2. At the moment of $3^{rd}$ microsecond (belonging to the first time period), a row driving voltage provided from the row driver circuit 104 through the row driving line L3 and the column driving voltage have an enough voltage difference for lighting on the light-emitting diodes R3 coupled to the row driving line L3. At the moment of $4^{th}$ microsecond (belonging to the second time period), a row driving voltage provided from the row driver circuit 104 through the row driving line L4 and the column driving voltage have an enough voltage difference for lighting on the light-emitting diodes R4 coupled to the row driving line L4. The rest light-emitting rows L5~L(2n) are lighted on in the same manner. In short, the first group of light-emitting rows L1, L3, . . . , L(2n−1) are alternately lighted-on with the second group of light-emitting rows L2, L4, . . . , L(2n).

Figure 4A:
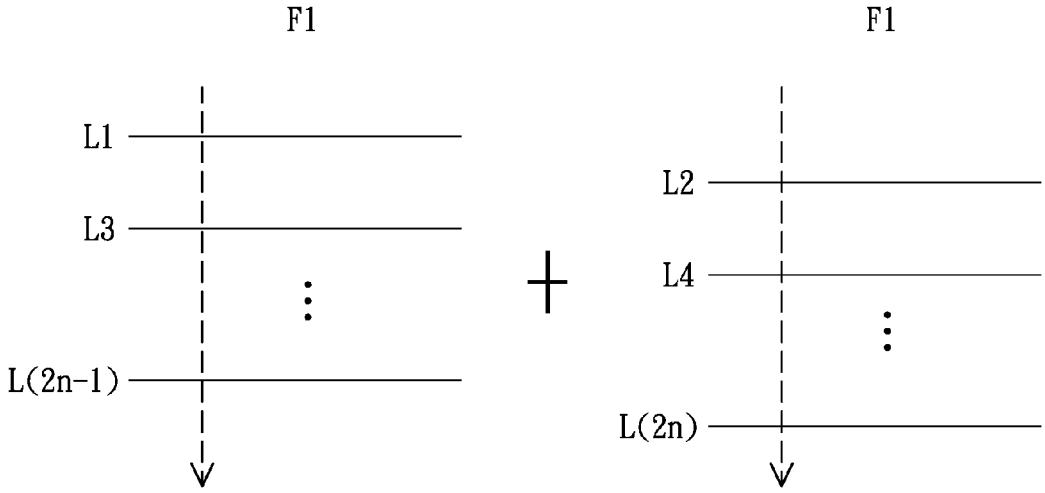
FIG. 4(*a*) shows another schematic scanning order used by the backlight driving method of FIG. 2 in a same frame period.
Figure 4B:
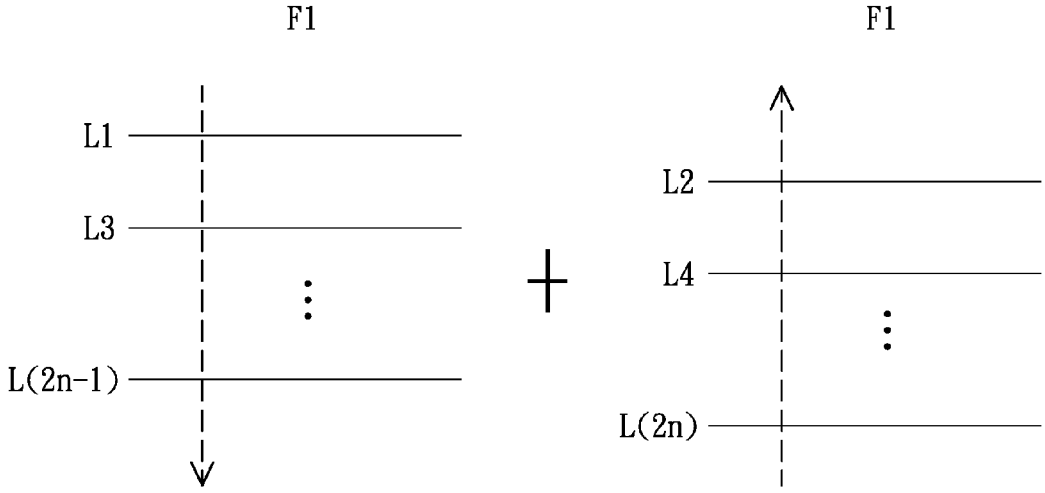
Figure 4C:
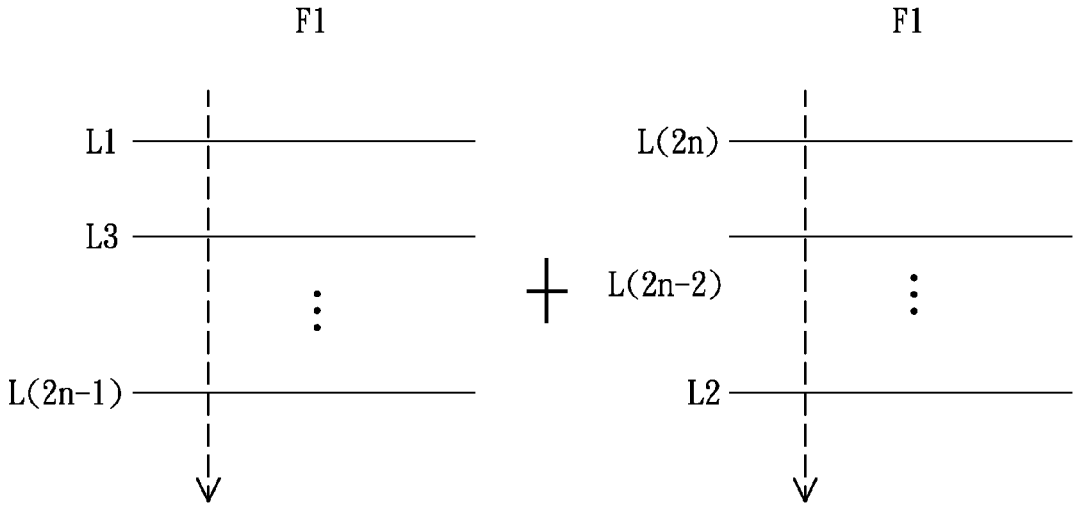

Referring to FIG. 4(*a*), showing another scanning order used by the backlight driving method of FIG. 2 in a same frame period. Herein, the first time period and the second time period both are in a frame period F1. A scanning time interval for row by row is assumed to be 1 microsecond and an exemplary embodiment will be described below in detail. In particular, at the moment of 1st microsecond (belonging to the first time period) in the frame period F1, a row driving voltage provided from the row driver circuit 104 through the row driving line L1 and the column driving voltage have an enough voltage difference for lighting on the light-emitting diodes R1 coupled to the row driving line L1. At the moment of $2^{nd}$ microsecond (belonging to the first time period) in the frame period F1, a row driving voltage provided from the row driver circuit 104 through the row driving line L3 and the column driving voltage have an enough voltage difference for lighting on the light-emitting diodes R3 coupled to the row driving line L3. At the moment of (n+l)th microsecond (belonging to the second time period) in the frame period F1, a row driving voltage provided from the row driver circuit 104 through the row driving line L2 and the column driving voltage have an enough voltage difference for lighting on the light-emitting diodes R2 coupled to the row driving line L2. At the moment of (n+2)th microsecond (belonging to the second time period) in the frame period F1, a row driving voltage provided from the row driver circuit 104 through the row driving line L4 and the column driving voltage have an enough voltage difference for lighting on the light-emitting diodes R4 coupled to the row driving line L4. In this illustrated embodiment, after the light-emitting row L(2n–1) of the first group of light-emitting rows L1, L3, . . . , L(2n–1) is lighted on, the light-emitting row L2 of the second group of light-emitting rows L2, L4, . . . , L(2n) subsequently is lighted on. Moreover, a scanning direction of the first group of light-emitting rows L1, L3, . . . , L(2n–1) being sequentially lighted on is the same as that of the second group of light-emitting rows L2, L4, . . . , L(2n) being subsequently lighted on.

Referring to FIG. 4(*b*), showing still another scanning order used by the backlight driving method of FIG. 2 in a same frame period. Herein, the first time period and the second time period both are in a frame period F1. A scanning time interval for row by row is assumed to be 1 microsecond and an exemplary embodiment will be described below in detail. In particular, at the moment of 1st microsecond (belonging to the first time period) in the frame period F1, a row driving voltage provided from the row driver circuit 104 through the row driving line L1 and the column driving voltage have an enough voltage difference for lighting on the light-emitting diodes R1 coupled to the row driving line L1. At the moment of $2^{nd}$ microsecond (belonging to the first time period) in the frame period F1, a row driving voltage provided from the row driver circuit 104 through the row driving line L3 and the column driving voltage have an enough voltage difference for lighting on the light-emitting diodes R3 coupled to the row driving line L3. At the moment of (n+1)th microsecond (belonging to the second time period) in the frame period F1, a row driving voltage provided from the row driver circuit 104 through the row driving line L(2n) and the column driving voltage have an enough voltage difference for lighting on the light-emitting diodes R(2n) coupled to the row driving line L(2n). At the moment of (n+2)th microsecond (belonging to the second time period) in the frame period F1, a row driving voltage provided from the row driver circuit 104 through the row driving line L(2n–2) and the column driving voltage have an enough voltage difference for lighting on the light-emitting diodes R(2n–2) coupled to the row driving line L(2n–2). In this illustrated embodiment, after the light-emitting row L(2n–1) of the first group of light-emitting rows L1, L3, . . . , L(2n–1) is lighted on, the light-emitting row L(2n) of the second group of light-emitting rows L2, L4, . . . , L(2n) subsequently is lighted on. Moreover, a scanning direction of the first group of light-emitting rows L1, L3, . . . , L(2n–1) being sequentially lighted on is reverse to another scanning direction of the second group of light-emitting rows L2, L4, . . . , L(2n) being sequentially lighted on.

Referring to FIG. 4(*c*), showing even still another scanning order used by the backlight driving method of FIG. 2 in a same frame period. Herein, the first time period and the second time period both are in a frame period F1. A scanning time interval for row by row is assumed to be 1 microsecond and an exemplary embodiment will be described below in detail. In particular, at the moment of 1st microsecond (belonging to the first time period) in the frame period F1, a row driving voltage provided from the row driver circuit 104 through the row driving line L1 and the column driving voltage have an enough voltage difference for lighting on the light-emitting diodes R1 coupled to the row driving line L1. At the moment of $2^{nd}$ microsecond (belonging to the first time period) in the frame period F1, a row driving voltage provided from the row driver circuit 104 through the row driving line L3 and the column driving voltage have an enough voltage difference for lighting on the light-emitting diodes R3 coupled to the row driving line L3. At the moment of $1^{st}$ microsecond (belonging to the second time period) in the frame period F1, a row driving voltage provided from the row driver circuit 104 through the row driving line L(2n) and the column driving voltage have an enough voltage difference for lighting on the light-emitting diodes R(2n) coupled to the row driving line L(2n). At the moment of $2^{nd}$ microsecond (belonging to the second time period) in the frame period F1, a row driving voltage provided from the row driver circuit 104 through the row driving line L(2n–2) and the column driving voltage have an enough voltage difference for lighting on the light-emitting diodes R(2n–2) coupled to the row driving line L(2n–2). In this illustrated embodiment, when the light-emitting row L(2n–1) of the first group of light-emitting rows L1, L3, . . . , L(2n–1) is lighted on, the light-emitting row L2 of the second group of light-emitting rows L2, L4, . . . , L(2n) is synchronously lighted on. Moreover, a scanning direction of the first group of light-emitting rows L1, L3, . . . , L(2n–1) being sequentially lighted on is reverse to another scanning direction of the second group of light-emitting rows L2, L4, . . . , L(2n) being sequentially lighted on.

Figure 5A:
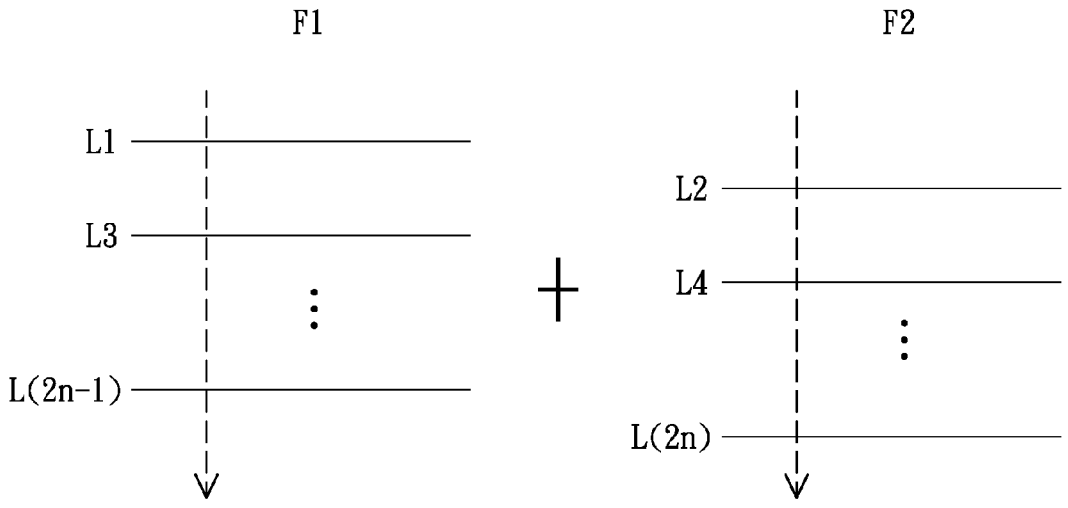
FIG. 5(*a*) shows a schematic scanning order used by the backlight driving method of FIG. 2 in different frame periods.
Figure 5B:
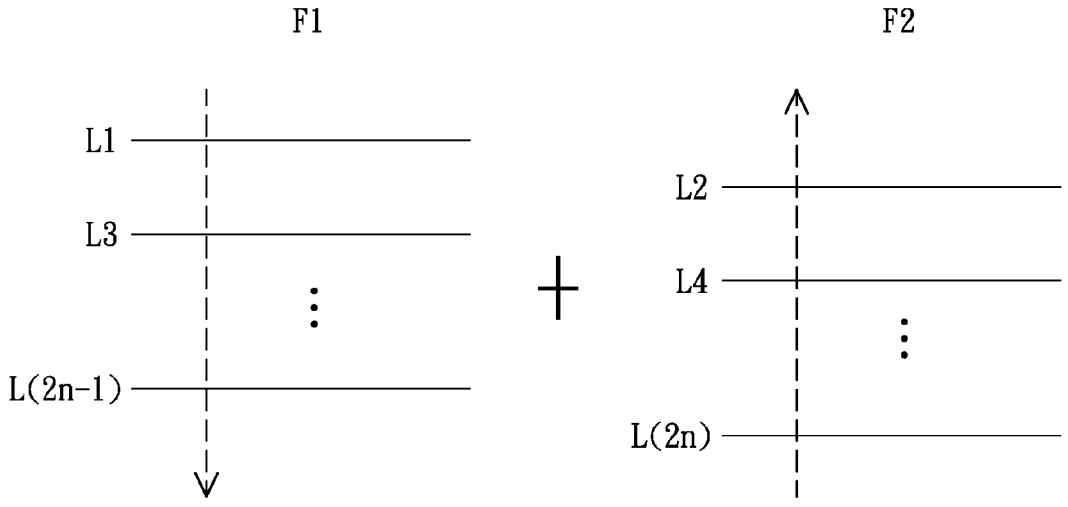

Referring to FIG. 5(*a*), showing a scanning order used by the backlight driving method of FIG. 2 in different frame periods. Herein, the first time period is in a first frame period F1, and the second time period is in a second frame period F2. A scanning time interval for row by row is assumed to be 1 microsecond and an exemplary embodiment will be described below in detail. Specifically, at the moment of 1st microsecond (belonging to the first time period) in the first frame period F1, a row driving voltage provided from the row driver circuit 104 through the row driving line L1 and the column driving voltage have an enough voltage difference for lighting on the light-emitting diodes R1 coupled to the row driving line L1. At the moment of $2^{nd}$ microsecond (belonging to the first time period) in the first frame period F1, a row driving voltage provided from the row driver circuit 104 through the row driving line L3 and the column driving voltage have an enough voltage difference for lighting on the light-emitting diodes R3 coupled to the row driving line L3. At the moment of $1^{st}$ microsecond (belonging to the second time period) in the second frame period F2, a row driving voltage provided from the row driver circuit 104 through the row driving line L2 and the column driving voltage have an enough voltage difference for lighting on the light-emitting diodes R2 coupled to the row driving line L2. At the moment of $2^{nd}$ microsecond (belonging to the second time period) in the second frame period F2, a row driving voltage provided from the row driver circuit 104 through the row driving line L4 and the column driving voltage have an enough voltage difference for lighting on the light-emitting diodes R4 coupled to the row driving line L4. In short, in this illustrated embodiment, the first group of light-emitting rows L1, L3, . . . , L(2n−1) are sequentially lighted on in the first frame period F1 with a forward scanning direction, and the second group of light-emitting rows L2, L4, . . . , L(2n) are sequentially lighted on in the second frame period F2 also with a forward scanning direction. In other words, the scanning direction of the first group of light-emitting rows L1, L3, . . . , L(2n−1) being sequentially lighted on in the first frame period F1 is the same as that of the second group of light-emitting rows L2, L4, . . . , L(2n) being sequentially lighted on in the second frame period F2.

Referring to FIG. 5(*b*), showing another scanning order used by the backlight driving method of FIG. 2 in different frame periods. Herein, the first time period is in a first frame period F1, and the second time period is in a second frame period F2. A scanning time interval for row by row is assumed to be 1 microsecond and an exemplary embodiment will be described below in detail. Specifically, at the moment of 1st microsecond (belonging to the first time period) in the first frame period F1, a row driving voltage provided from the row driver circuit 104 through the row driving line L1 and the column driving voltage have an enough voltage difference for lighting on the light-emitting diodes R1 coupled to the row driving line L1. At the moment of $2^{nd}$ microsecond (belonging to the first time period) in the first frame period F1, a row driving voltage provided from the row driver circuit 104 through the row driving line L3 and the column driving voltage have an enough voltage difference for lighting on the light-emitting diodes R3 coupled to the row driving line L3. At the moment of $1^{st}$ microsecond (belonging to the second time period) in the second frame period F2, a row driving voltage provided from the row driver circuit 104 through the row driving line L(2n) and the column driving voltage have an enough voltage difference for lighting on the light-emitting diodes R(2n) coupled to the row driving line L(2n). At the moment of $2^{nd}$ microsecond (belonging to the second time period) in the second frame period F2, a row driving voltage provided from the row driver circuit 104 through the row driving line L(2n−2) and the column driving voltage have an enough voltage difference for lighting on the light-emitting diodes R(2n−2) coupled to the row driving line L(2n−2). In short, in this illustrated embodiment, the first group of light-emitting rows L1, L3, . . . , L(2n−1) are sequentially lighted on in the first frame period F1 with a forward scanning direction, and the second group of light-emitting rows L2, L4, . . . , L(2n) are sequentially lighted on in the second frame period F2 with a reverse scanning direction. In other words, the scanning direction of the first group of light-emitting rows L1, L3, . . . , L(2n−1) being sequentially lighted on in the first frame period F1 is different from that of the second group of light-emitting rows L2, L4, . . . , L(2n) being sequentially lighted on in the second frame period F2.

In summary, the above-mentioned embodiments of the present invention employ a multi-phase (e.g., 2-phase) scanning scheme to drive the light source array of a backlight module and make the backlight driving frequency be different from the gate driving frequency, so that breaking down a constant frequency difference between the gate driving frequency and the backlight driving frequency associated with the prior art which would cause the fan effect (i.e., generally waving noise or visual noise). Accordingly, the image quality of display device is improved.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A backlight driving method adapted to a display device, the display device comprising a light source array constituted by a plurality of light-emitting diodes arranged in an array, the light source array comprising a first group of light-emitting rows and a second group of light-emitting rows, each of the light-emitting rows being constituted by a plurality of light-emitting diodes in a row; the backlight driving method comprising steps of:

receiving a gate driving frequency of the display device;

generating a backlight driving frequency, according to the gate driving frequency; and sequentially providing a first row driving voltage to the first group of light-emitting rows in a first time period and sequentially providing a second row driving voltage to the second group of light-emitting rows in a second time period, according to the backlight driving frequency;

wherein the first time period and the second time period have different phases from each other, and the gate driving frequency is different from the backlight driving frequency.

2. The backlight driving method as claimed in claim 1, wherein the first time period and the second time period are in a same frame period of the display device.

3. The backlight driving method as claimed in claim 2, wherein the step of sequentially providing a first row driving voltage to the first group of light-emitting rows in a first time period and sequentially providing a second row driving voltage to the second group of light-emitting rows in a second time period comprises:

sequentially providing the first row driving voltage and the second row driving voltage to the respective first group of light-emitting rows and second group of light-emitting rows in an alternate manner.

4. The backlight driving method as claimed in claim 2, wherein a scanning direction of sequentially providing the first row driving voltage to the first group of light-emitting rows is the same as a scanning direction of sequentially providing the second row driving voltage to the second group of light-emitting rows.

5. The backlight driving method as claimed in claim 2, wherein a scanning direction of sequentially providing the first row driving voltage to the first group of light-emitting rows is different from a scanning direction of sequentially providing the second row driving voltage to the second group of light-emitting rows.

6. The backlight driving method as claimed in claim 1, wherein the first time period and the second time period are in different frame periods of the display device.

7. The backlight driving method as claimed in claim 6, wherein the step of sequentially providing a first row driving voltage to the first group of light-emitting rows in a first time period and sequentially providing a second row driving voltage to the second group of light-emitting rows in a second time period comprises:

sequentially providing the first row driving voltage and the second row driving voltage to the respective first group of light-emitting rows and second group of light-emitting rows in an alternate manner.

8. The backlight driving method as claimed in claim 6, wherein a scanning direction of sequentially providing the first row driving voltage to the first group of light-emitting rows is the same as a scanning direction of sequentially providing the second row driving voltage to the second group of light-emitting rows.

9. The backlight driving method as claimed in claim 6, wherein a scanning direction of sequentially providing the first row driving voltage to the first group of light-emitting rows is different from a scanning direction of sequentially providing the second row driving voltage to the second group of light-emitting rows.

10. A display device comprising:

a light source array constituted by a plurality of light-emitting diodes arranged in an array, comprising a first group of light-emitting rows and a second group of light-emitting rows, wherein each of the light-emitting rows being constituted by a plurality of light-emitting diodes in a row;

a column driver circuit, electrically coupled to the light source array and being for providing a column driving voltage to the light source array; and a row driver circuit, electrically coupled to the light source array, being for generating a backlight driving frequency according to a received gate driving frequency of the display device, and sequentially providing a first row driving voltage to the first group of light-emitting rows in a first time period and sequentially providing a second row driving voltage to the second group of light-emitting rows in a second time period according to the backlight driving frequency;

wherein a phase of the first time period is different from a phase of the second time period, and the gate driving frequency is different from the backlight driving frequency.

11. The display device as claimed in claim 10, wherein the first time period and the second time period are in a same frame period of the display device.

12. The display device as claimed in claim 11, wherein sequentially providing a first row driving voltage to the first group of light-emitting rows in a first time period and sequentially providing a second row driving voltage to the second group of light-emitting rows in a second time period associated with the row driver circuit comprises:

sequentially providing the first row driving voltage and the second row driving voltage to the respective first group of light-emitting rows and second group of light-emitting rows in an alternate manner.

13. The display device as claimed in claim 11, wherein a scanning direction of sequentially providing the first row driving voltage to the first group of light-emitting rows is the same as a scanning direction of sequentially providing the second row driving voltage to the second group of light-emitting rows.

14. The display device as claimed in claim 11, wherein a scanning direction of sequentially providing the first row driving voltage to the first group of light-emitting rows is different from a scanning direction of sequentially providing the second row driving voltage to the second group of light-emitting rows.

15. The display device as claimed in claim 10, wherein the first time period and the second time period are in different frame periods of the display device.

16. The display device as claimed in claim 15, wherein sequentially providing a first row driving voltage to the first group of light-emitting rows in a first time period and sequentially providing a second row driving voltage to the second group of light-emitting rows in a second time period associated with the row driver circuit comprises:

sequentially providing the first row driving voltage and the second row driving voltage to the respective first group of light-emitting rows and second group of light-emitting rows in an alternate manner.

17. The display device as claimed in claim 15, wherein a scanning direction of sequentially providing the first row driving voltage to the first group of light-emitting rows is the same as a scanning direction of sequentially providing the second row driving voltage to the second group of light-emitting rows.

18. The display device as claimed in claim 15, wherein a scanning direction of sequentially providing the first row driving voltage to the first group of light-emitting rows is different from a scanning direction of sequentially providing the second row driving voltage to the second group of light-emitting rows.

19. The display device as claimed in claim 10, wherein when the column driving voltage and the first row driving voltage have a voltage difference, at least one of the first group of light-emitting rows is lighted on.

20. The display device as claimed in claim 10, wherein when the column driving voltage and the second row driving voltage have a voltage difference, at least one of the second group of light-emitting rows is lighted on.

21. The display device as claimed in claim 10, wherein the light source array is an organic light source array.

22. The display device as claimed in claim 10, wherein the light source array is a field emission backlight source array.

23. The backlight driving method as claimed in claim 1, wherein each of the light-emitting diodes has an anode electrically coupled to a corresponding column driving line, and a cathode electrically coupled to a corresponding row driving line.

24. The display device as claimed in claim 10, wherein each of the light-emitting diodes has an anode electrically coupled to a corresponding column driving line, and a cathode electrically coupled to a corresponding row driving line.

* * * * *